US005975247A

United States Patent [19]

Choi

[11] Patent Number: 5,975,247

[45] Date of Patent: Nov. 2, 1999

[54] ELEVATOR CAR CALL REGISTER APPARATUS AND METHOD THEREOF

[75] Inventor: Lak Hwan Choi, Changwon, Rep. of Korea

[73] Assignee: LG Industrial Systems Co., Ltd., Seoul, Rep. of Korea

[21] Appl. No.: 08/978,575

[22] Filed: Nov. 26, 1997

[30] Foreign Application Priority Data

Nov. 28, 1996 [KR] Rep. of Korea ..... 96/58668

[51] Int. Cl.[6] ..... B66B 1/16; B66B 1/34

[52] U.S. Cl. ..... 187/380; 187/395

[58] Field of Search ..... 187/380, 395, 187/381, 389

[56] References Cited

U.S. PATENT DOCUMENTS

| | | | |
|---|---|---|---|
| 3,493,922 | 2/1970 | Lass | 187/380 |
| 4,149,614 | 4/1979 | Mandel et al. | 187/397 |
| 4,614,931 | 9/1986 | Sasso | 187/380 |
| 4,709,788 | 12/1987 | Harada | 187/382 |
| 4,718,520 | 1/1988 | Schroder | 187/380 |
| 4,872,532 | 10/1989 | Tobita et al. | 187/391 |
| 4,915,197 | 4/1990 | Schroder | 187/380 |

*Primary Examiner*—Robert E. Nappi

[57] ABSTRACT

An elevator car call register apparatus and a method thereof, which relates to processing a car call which a passenger registers in an elevator car and in which a plurality of call buttons of a multiple of 10 and a plurality of call buttons of a single digit are separately provided, is capable of controlling calls for a large number of floors with a plurality of call buttons having the smaller number than the number of floors. When a passenger presses a call button of a multiple of 10 and a call button of a single digit, the apparatus according to the present invention stores each data generated in accordance with calls of the multiple of 10 and the single digit in a memory in a predetermined format, when the passenger presses a set button, the apparatus determines that the call for a desired floor is normally performed, and combines the data stored in the memory, and outputs to a car controller, thus enabling the elevator car to move to the desired floor.

4 Claims, 7 Drawing Sheets

FIG. 4
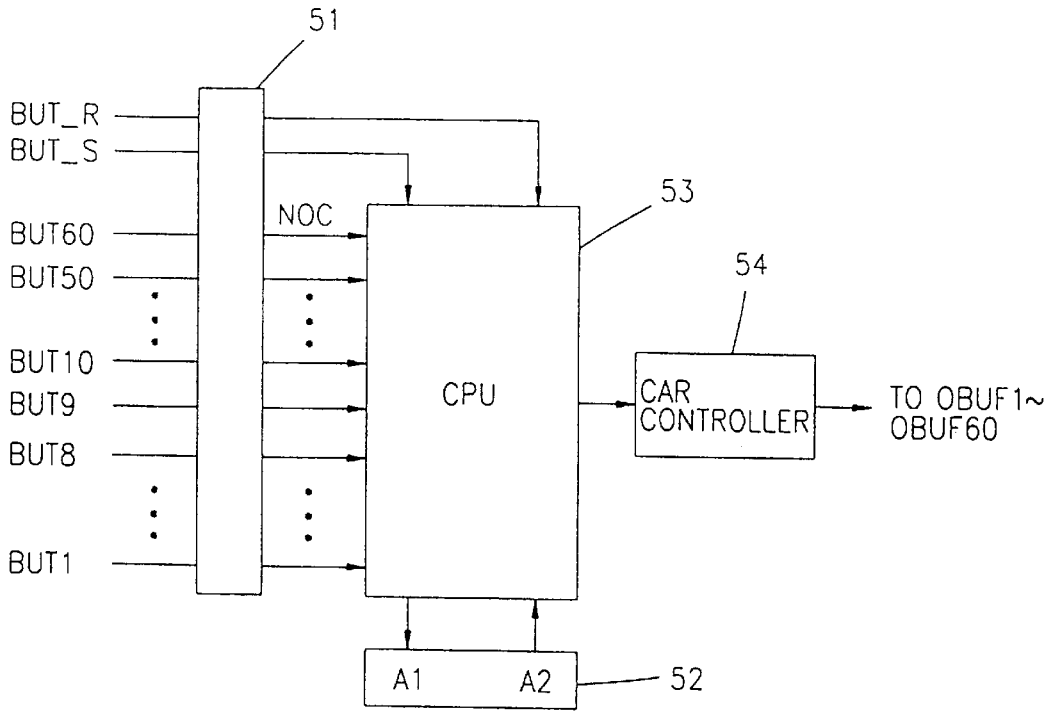
FIG. 6A
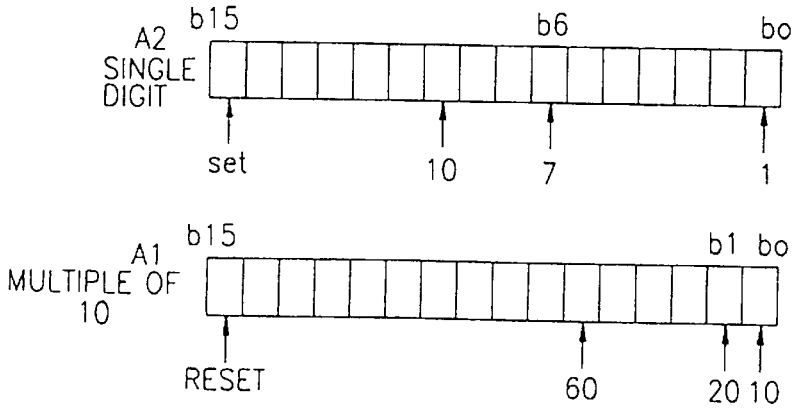
FIG. 6B

ELEVATOR CAR CALL REGISTER APPARATUS AND METHOD THEREOF

BACKGROUND OF THE INVENTION

1. Field of the Invention

The present invention relates to registering a call in an elevator car, and in particular to an improved elevator car call register apparatus and a method thereof, capable of registering a call with respect to the whole floors in a building where an elevator provides service by using less call buttons.

2. Description of the Conventional Art

FIG. 1 is a diagram roughly illustrating a control panel of a conventional elevator car. As shown therein, a closing button 2 and an opening button 3 are positioned at a lower part of a control panel 1, and a plurality of call buttons BT1–BT60 which equal to the number of floors where the elevator provides service are sequentially located at an upper part of the panel 1, wherein each number marked on each of call buttons BT1–BT60 indicates each floor. In this specification, suppose that there are 60 floors that the elevator provides service, and thus the number of call buttons is 60.

FIGS. 2A and 2B are circuit diagrams illustrating a state that a car call is registered in the conventional elevator car, of which FIG. 2A is an input circuit diagram, and FIG. 2B is a car call register indicating circuit diagram.

As shown in FIG. 2A, an input circuit includes a plurality of input buffers IB1–IB60, which equal to the number of the floors, that is 60, are connected in parallel between a first power source line P24B and a communication line NOC, and the plurality of call buttons BT1–BT60 are respectively connected between a second power source line GD22A and each of the input buffers IB1–IB60. Here, the first power source line P24B receives a first power source, the second power source line GD22A receives a second power source, and the communication line NOC is connected with a car controller (not shown).

As shown in FIG. 2B, a car call register indicating circuit includes a plurality of lamps LED1–LED60 and a plurality of output buffers OBUF1–OBUF60, equivalent to the number of floors and are connected in series between a third power source line A24 and a signal line B24. The third power source line A24 receives a third power source, and the signal line B24 is connected with the car controller.

The operation of the thusly described circuit will be described with reference to accompanying drawings.

First, when a passenger presses a call button, on which a number corresponding to a destination floor where he/she wants to reach is marked, among the 60 call buttons BT1–BT60 installed in the control panel 1, the second power source line GD22A supplies power to a corresponding input buffer among the input buffers IB1–IB60, and accordingly the corresponding input buffer is enabled and outputs a call signal, and the thusly outputted call signal is transmitted to the car controller.

Accordingly, the car controller controls the elevator car to move to the desired floor and outputs an enable signal to the signal line B24, a corresponding one of the output buffers OBUF1–OBUF60 is enabled by the enable signal, whereby the third power source is supplied to a corresponding lamp of the lamps LED1–LED60, connected with the output buffers OBUF1–OBUF60, through the third power source line A24, and accordingly the corresponding lamp is turned on.

Since each of the lamps LED1–LED60 is installed inside the corresponding call button of a transparent material, the passenger may notice whether the call of the desired floor is registered.

If a passenger boarding on a first floor presses a call button BT27 to reach a 27th floor, a call signal is outputted from an input buffer IB27, the car controller outputs a corresponding enable input signal, and an output buffer OBUF27 is set by the enable signal, and a lamp LED27 corresponding to the 27th floor is turned on. Accordingly, the passenger may know that the call for the 27th floor is registered.

However, in the conventional art, the number of call buttons are identical to the number of the floors that the elevator car provides service. Therefore, when it is a building of 60 floors, 60 call buttons should be installed in the control panel 1. So, the higher the building is, the more call buttons should be installed in the control panel. Accordingly, the constructions of the circuit for processing a call for each floor, and the control panel become more complicated, and consequently the manufacturing cost is increased.

In addition, once a call for a desired floor is registered by a passenger, it is impossible to cancel the call registration though it is the wrong call, so that the elevator car provides service to an undesired floor. Accordingly, power is unnecessarily consumed, and also the passenger may be displeased at delay of service.

SUMMARY OF THE INVENTION

Accordingly, it is a first object of the present invention to provide an elevator car call register apparatus and a method thereof which has call register buttons for registering a desired floor, in which two groups of call register buttons are provided, that is one of a single digit and the other of each multiple of 10, and combines signals which are generated in accordance with the operation of corresponding call register buttons, thus registering a call for the floor which a passenger desires to reach.

It is a second object of the present invention to provide an elevator car call register apparatus and a method thereof, capable of cancelling a call which a passenger registers, thereby enabling the passenger to cancel the registration when he/she pushes a wrong button.

To achieve the above objects, there is provided an elevator car call register apparatus, including: a plurality of call buttons of a multiple of 10 and a plurality of call buttons of a single digit; a first power source; a second power source connected to one terminal of each of the call register buttons; a buffer unit, having a plurality of input buffers of each of which has one input terminal connected with a first power source and the other input terminal connected with the other terminal of the call register buttons, for outputting a call signal in accordance with a second power source which is generated by pressing a call register button; a memory for storing data of information for selecting a floor desired by a passenger, corresponding to a call signal outputted from the buffer unit, in each separate location; a CPU for receiving and storing the call signal outputted from the buffer unit in the memory, and outputting a signal by combining data, each corresponding to the call of the single digit and the call of the multiple of 10, which are stored in the memory; and a car controller for controlling an elevator car operated in accordance with a signal outputted from the CPU, and applying an enable signal to the output buffer, thus turning on a register indicating lamp connected with the output buffer.

In order to achieve the second object, there is provided an elevator car call register apparatus, including a set button for setting a call which is registered by a passenger, and a reset button for cancelling a registered call.

To achieve the first and second objects, there is provided an elevator car call register method, including a first step for making the CPU recognize a call when a passenger presses a call button, a second step for storing each data, corresponding to the single digit call and the call of the multiple of 10, in the memory in a predetermined format when the call is judged to be appropriate, or clearing data stored in the memory when the call is not appropriate and ending the system, and a third step for determining a call, generated when the set button is pressed, is a correct one, combining data stored in the memory, and outputting the thus combined data to the car controller, thereby enabling the car controller to service the elevator car to move to a desired floor and clearing data stored in the memory.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a diagram illustrating an embodiment of an elevator car call register apparatus according to the present invention;

FIGS. 6A and 6B are format diagrams, each illustrating data A1 and A2 in a memory of FIG. 5.

DETAILED DESCRIPTION OF THE INVENTION

Figure 3:
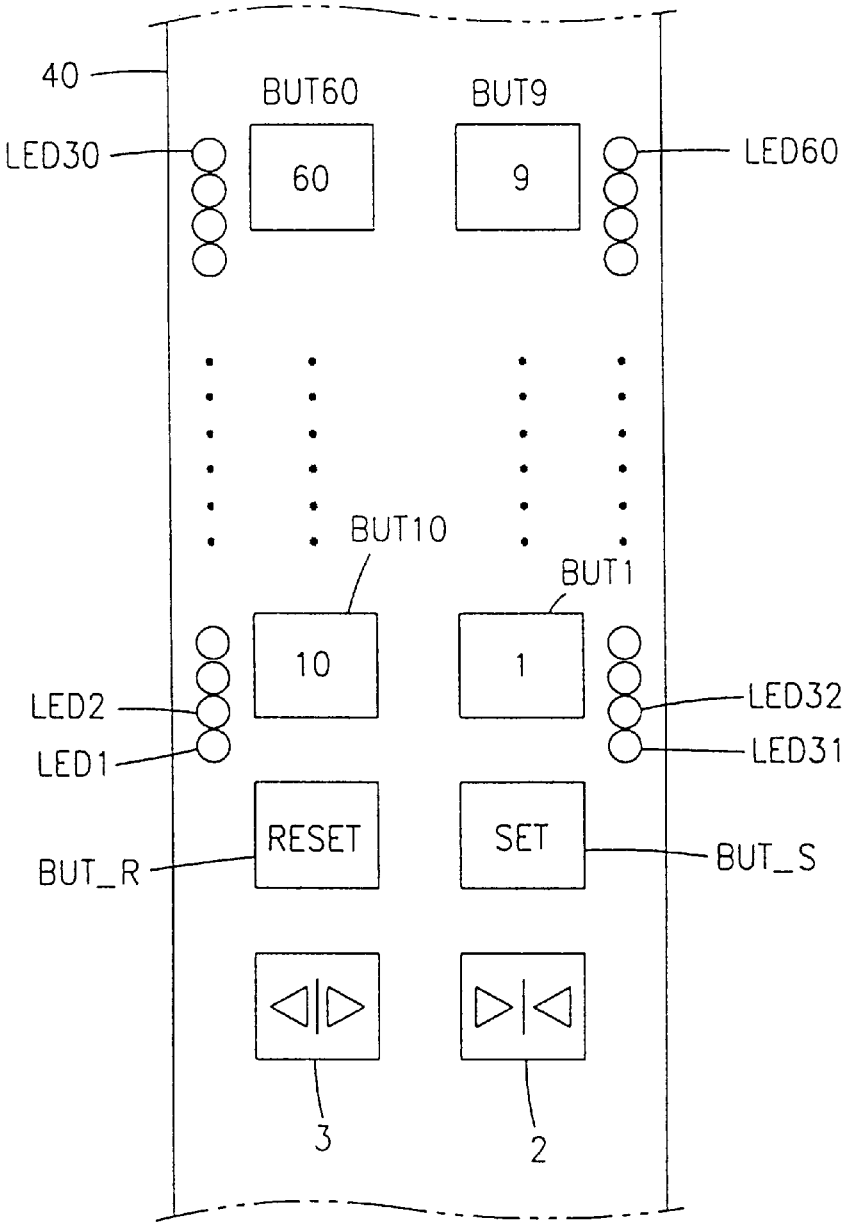
FIG. 3 is a diagram illustrating a control panel of an elevator car according to the present invention.

FIG. 3 is a diagram illustrating a control panel of an elevator car according to the present invention. As shown therein, the control panel includes a closing button 2, an opening button 3, a plurality of call buttons BUT10,BUT20 . . . BUT60 for receiving a call of a multiple of 10 and a plurality of call buttons BUT1–BUT9 for receiving a call of a single digit, a plurality of lamps LED1–LED60, equivalent to the number of floors where an elevator car provides service, a set button BUT_S for setting a call, generated by the two groups of the call buttons (BUT10,BUT20 . . . BUT60), (BUT1–BUT9), and a reset button BUT_R for resetting a call, also generated by the two groups of the call buttons.

The 6 call buttons of 6 multiple numbers of 10 BUT10, BUT20 . . . BUT60 are provided when the number of whole floors where the elevator car provides service is 60. Similarly, when the number of whole floors is 80, the number of call buttons for receiving a call of a multiple of 10 is 8.

FIG. 4 is a diagram illustrating an embodiment of an elevator car call register apparatus according to the present invention. As shown therein, the elevator car call register apparatus includes: a buffer unit 51 for outputting a signal generated by which the call buttons of the multiples of 10 BUT10,BUT20 . . . BUT60, the call buttons of each single digit BUT1–BUT9, the set button BUT_S, or the reset button BUT_R is pressed; a memory 52 for storing data in accordance with the call buttons in each separate location; a CPU 53 for storing the call signal outputted from the buffer unit 51 in the memory 52 when a passenger presses the call buttons (BUT10,BUT20 . . . BUT60), (BUT1–BUT9), and receiving a reset signal from the buffer unit 51 and resetting data stored in the memory 52 when the reset button BUT_R is pressed, and receiving a set signal when the set button BUT_S is pressed and processing data stored in the memory 52; and a car controller 54 for outputting a signal received from the CPU 53 to a corresponding one of the output buffers OBUF1–OBUF60 and controlling the elevator car operated in accordance with the signal outputted from the CPU 53.

The buffer unit 51 is provided with a plurality of input buffers (IBUF1–IBUF9), (IBUF10,IBUF20 . . . IBUF60), (IBUF_S), (IBUF_R), as shown in FIG. 5.

Figure 5:
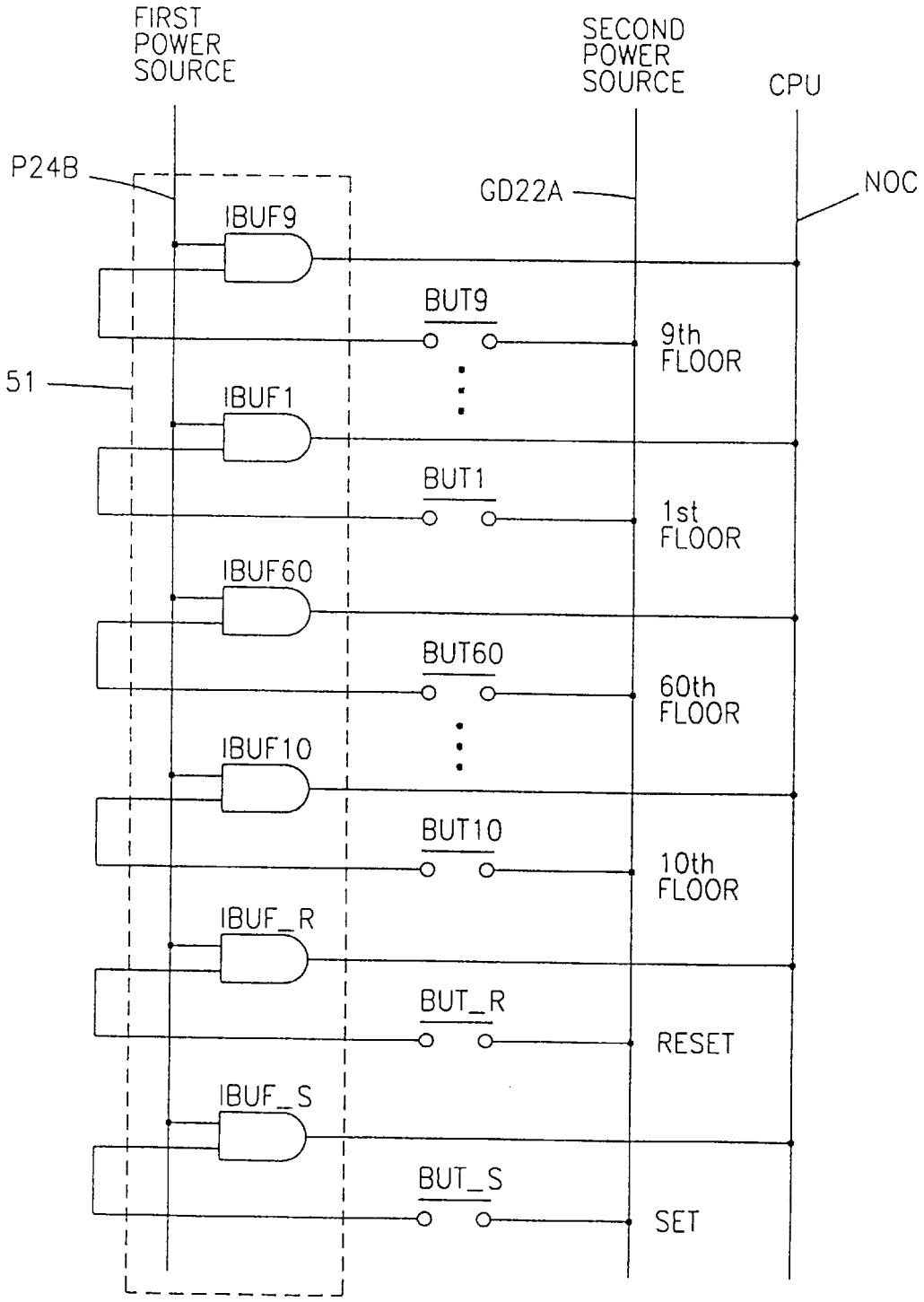
FIG. 5 is a diagram illustrating an embodiment of an elevator car call register input circuit according to the present invention.

FIG. 5 is a diagram illustrating an embodiment of an elevator car call register input circuit according to the present invention. As shown therein, the plurality of input buffers (IBUF1–IBUF9), (IBUF10,IBUF20 . . . IBUF60), (IBUF_S), (IBUF_R) are connected in parallel between a first power source line P24B and a communication line NOC. Each of the call buttons for the multiples of 10 BUT10,BUT20 . . . BUT60, call buttons for the 9 single digits BUT1–BUT9, set button BUT_S, and reset button BUT_R is connected each other between a second power source line GD22A and each input terminal of the input buffers (IBUF1–IBUF9), (IBUF10,IBUF20 . . . IBUF60), (IBUF_S), (IBUF_R). The first and second power source lines P24B, GD22A receive a first power source and a second power source, respectively, and the communication line NOC is connected with the CPU 53.

Figure 1:
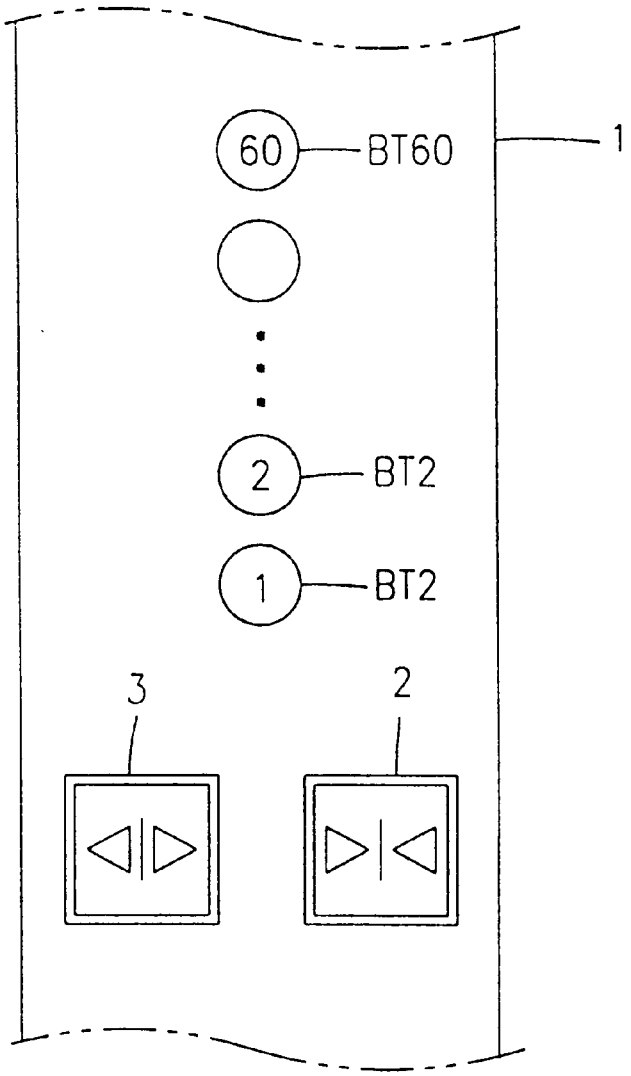
FIG. 1 CONVENTIONAL ART
FIG. 1 is a diagram roughly illustrating a control panel of a conventional elevator car.
Figure 2A:
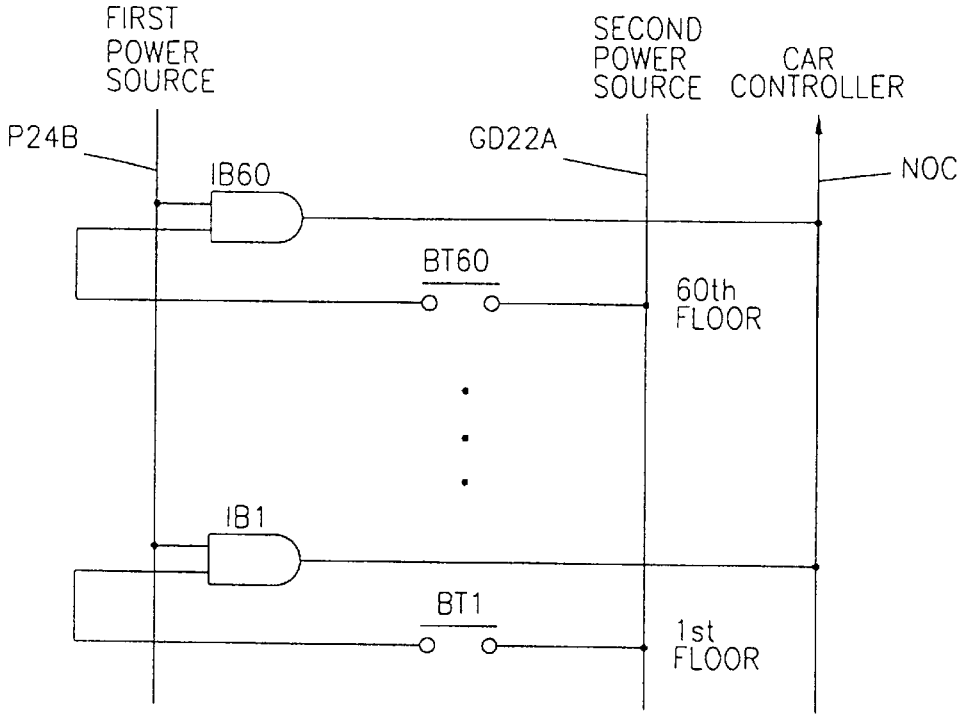
FIG. 2A CONVENTIONAL ART
FIG. 2A is an input circuit diagram of a conventional elevator car call register circuit diagram.
Figure 2B:
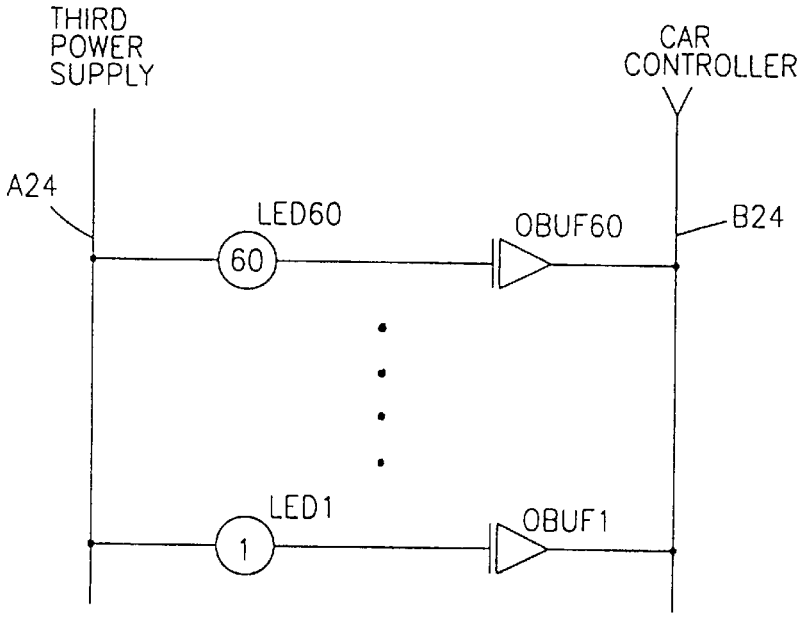
FIG. 2B CONVENTIONAL ART
FIG. 2B is an indicating circuit diagram of the conventional elevator car call register circuit diagram.

Since a diagram of an embodiment of an elevator car call register indicating circuit is identical to FIG. 2B, the conventional elevator car call register indicating circuit diagram, the description thereof will be omitted.

Figure 7A:
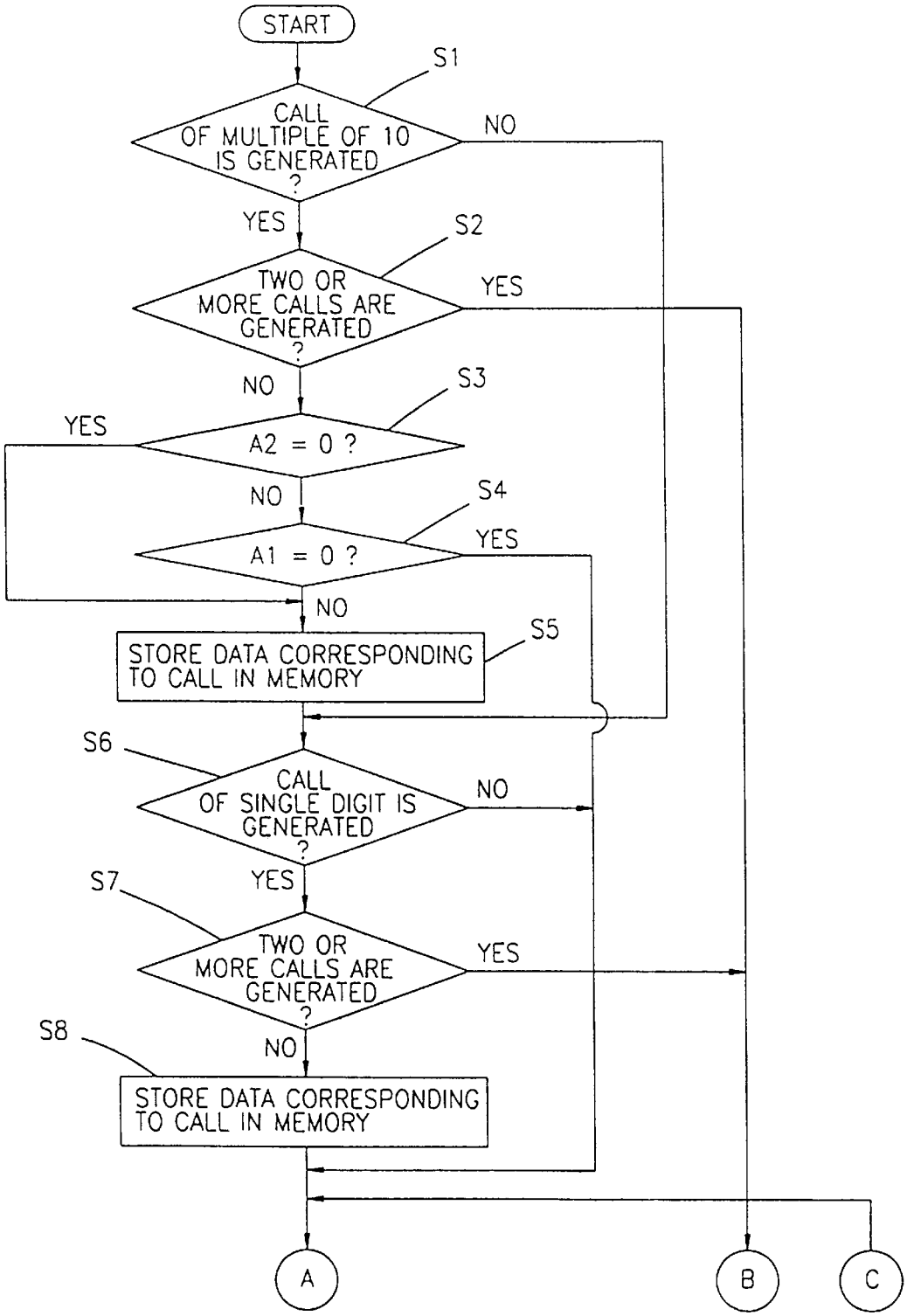
FIGS. 7(A) and 7(B) are flow charts illustrating an elevator car call register method according to the present invention.
Figure 7B:
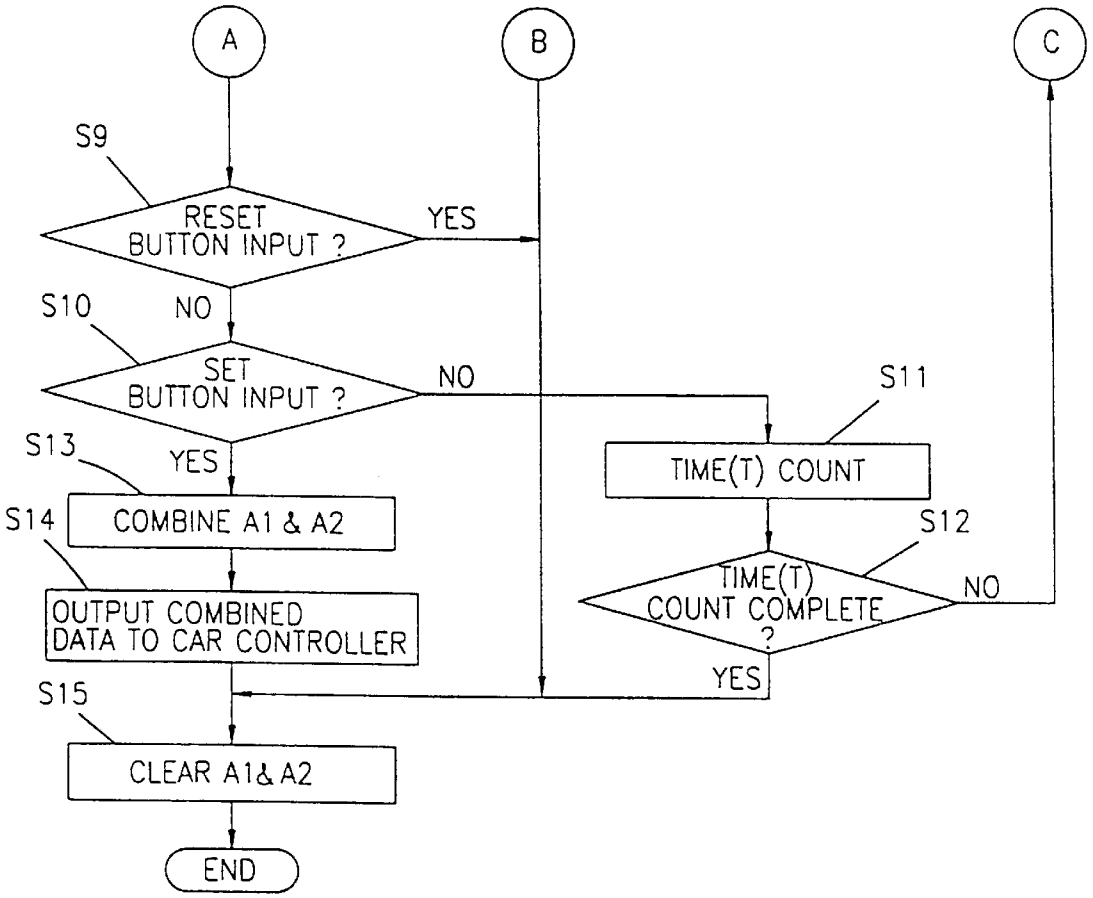

With reference to FIGS. 6 and 7, the operation of the embodiment of the elevator car call register apparatus according to the present invention will be described.

When a passenger presses one or more call buttons among the 6 call buttons of multiples of 10 BUT10,BUT20 . . . BUT60 and the 9 call buttons of single digits BUT1–BUT9, the second power source is inputted to a corresponding input buffer of the input buffers (IBUF1–IBUF9), (IBUF10, IBUF20 . . . IBUF60), and accordingly the corresponding input buffer is enabled and a call signal is outputted therefrom and inputted to the CPU 53 through the communication line NOC. The CPU 53 determines whether the call signal is an appropriate one, that is the call is normally generated. If the CPU 53 determines that the call is the appropriate one, the CPU 53 stores data in accordance with the registered call in the memory 52 in a predetermined format.

FIGS. 6A and 6B are diagrams illustrating each data format of the memory 52. FIG. 6B illustrates data A1 which correspond to each of the call buttons of the multiples of 10, wherein each bit b0–b6 corresponds to each floor which is a multiple of 10 (10,20 . . . 60), and the highest bit corresponds to the reset button BUT_R. FIG. 6A illustrates data A2 which correspond to the call buttons of the single digits, wherein each bit b0–b8 corresponds to each single digit floor (1,2 . . . 9), and the highest bit corresponds to the set button BUT_S. Each of data A1,A2 is comprised of 16 bits. With reference to FIG. 7, the operation of the CPU 53 for determining whether the call signal is an appropriate one will be described in detail.

A step 1 S1 determines whether a call of a multiple of 10 is generated. If the step 1 S1 determines that the call of the multiple of 10 is not generated, a step 1 S1 determines whether a call of a single digit is generated. If the step 6 S6 determines that the call of the multiple of 10 is generated, a step 2 S2 determines whether two or more call buttons of a multiple of 10 are pressed. If the step 2 S2 determines that two or more call buttons of the multiple of 10 are pressed, the step 2 S2 judges that the passenger pressed a wrong button and jumps to a step 15 S15. Accordingly, the data A1, A2 stored in the memory 52 are cleared and the operation is completed.

When a single button among the call buttons of the multiple of 10 (BUT10,BUT20 . . . BUT60) is pressed, steps 3 and 4 S3,S4 determine whether a call of the single digit is generated first, and later, a call of the multiple of 10 is generated by checking values stored in data A1,A2 of the memory 52. That is, if a call is normally registered, first the passenger should press the call button of the multiple of 10, and then press the call button of the single digit. Accordingly, if the call of the single digit has already been generated when the call button of the multiple of 10 is pressed, it is determined that the passenger made a mistake in pressing the call button, and the flow jumps to the step 15 S15, thus the operation is completed. If the step 4 S4 is satisfied, a step 5 S5 stores the data A1, which correspond to the call button of the multiple of 10, in the memory 52. For example, when a call button of the multiple of 10 BUT20 is pressed, a second bit b1 of the corresponding data A1 thereof becomes 1.

Next, a step 6 S6 determines whether the call of the single digit is generated, and a step 7 S7 determines whether two or more calls of the single digit are generated. If the step 7 S7 determines that two or more calls of the single digit are not generated, that is one call of the single digit is only generated, a step 8 S8 stores data which correspond to the call button of the single digit in the memory 52. For example, when a call button of the single digit BUT7 is pressed, a seventh bit b6 of the corresponding data A2 thereof becomes 1.

Since the number of whole floors where the elevator car provides service is 60 in the specification, a value which corresponds to one of the call buttons BUT10,BUT20 . . . BUT60 is stored in one of the bits b0–b6 of the data A1, and a value which corresponds to one of the call buttons BUT1–BUT9 is stored in one of the bits b0–b8 of the data A2. For instance, if the passenger wants to reach a 27th floor and a call button BUT7 of the single digit is pressed after a call button BUT20 of the multiple of 10, a bit b1 of the data A1 in the memory 52 becomes 1, and a bit b6 of the data A2 therein becomes 1.

If the operation has been completed up to the step 8 S8, a step 9 S9 determines whether the set button BUT_S is pressed after a predetermined time T. Here, the time T is a maximum setup time that may elapse until the passenger presses the set button when he/she thinks that the call button is normally inputted.

If the set button BUT_S is pressed within the time T, it is determined that the call register is completed without failure, and the CPU 53 combines the data A1,A2, stored in the memory 52 and outputs the combined data to the car controller 54 in steps 13 and 14 S13,S14, thus transmitting information with respect to the floor for which the passenger generated the call to the car controller 54. That is, when a bit value of the data A1, stored in the memory 52, is '0000000000000010', and a bit value of the data A2, also stored in the memory 52, is '1000000001000000', it means that a call for the 27th floor is registered, meaning that the call for the 27th floor is transmitted to the car controller 54.

By clearing the data A1, A2 of the memory 52 after the information is transmitted, a step 15 S15 initializes the whole system. On the contrary, when the set button BUT_S is not pressed until the predetermined time T has elapsed, the step 15 S15 determines that the passenger erroneously operated the control panel system, and clears the data A1,A2.

In addition, when the passenger presses the reset button BUT_R before the set button BUT_S, flow proceeds from step 9 S9 to step 15 S15 which clears the data A1,A2. That is, the reset button BUT_R enables the passenger to cancel the erroneous handling of the panel.

When the passenger presses the set button BUT_S and reset button BUT_R, the second power source is supplied to the input buffers IBUF_S,IBUF_R through the second power source line GD22A, and accordingly a call signal, generated in a corresponding input buffer, is inputted to the CPU 53 through the signal line NOC.

When the car controller 54 controls the elevator car to move to the desired floor in accordance with the registered call signal and outputs an enable signal through the signal line B24, the corresponding output buffer among the output buffers OBUT1–OBUT60 is enabled by the enable signal. Therefore, the third power source is supplied to a corresponding lamp among the lamps LED1–LED60, connected with the corresponding output buffer, through the third power source line A24, and the corresponding lamp is turned on.

For example, when a call for the 27th floor is registered, the car controller 54 controls the elevator car to move to the 27th floor and operates the output buffer OBUF27, thereby turning the lamp LED27 on.

For the convenience of the description for the embodiment according to the present invention, the CPU 53 and the car controller 54 are separately provided, and accordingly the operation thereof is separately described. However, when the elevator car call register apparatus and the method thereof according to the present invention is applied to an actual elevator system, a microprocessor which is installed in the car controller 54 serves as the CPU 53. Therefore, the car controller comes to have the car controlling function as well as the function of the CPU.

As described above, the elevator car call register apparatus and the method thereof according to the present invention, applying only the 15 call buttons, enable each car call of 60 floors to be registered. If it is 100 floors that the elevator car provides service, the elevator car may be operated only with 20 call buttons provided. Therefore, the control panel of the elevator car can simply be designed, thus facilitating use thereof and reducing the manufacturing costs.

In addition, by providing the set and reset buttons, the elevator car call register apparatus and the method thereof according to the present invention enables the passenger to cancel the call which is incorrectly registered, thus effectively operating the elevator system.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. In an elevator provided with a plurality of register indicating lamps, equivalent to the number of floors that the elevator provides service, and a plurality of output buffers which are respectively connected with the register indicating lamps, an elevator car call register method comprising:

a first step for making a CPU recognize a call when a passenger presses a call button of a multiple of 10 and a call button of a single digit;

a second step of storing each data, corresponding to a call of the single digit and a call of the multiple of 10, in a memory in a predetermined format when the call is judged to be appropriate or clearing data stored in the memory when the call is not appropriate; and a third step for determining that a call, generated when a set button is pressed, is a correct one, combining the data stored in the memory, and outputting the combined data to the car controller, thereby enabling a car controller to initiate movement of the elevator car to a desired floor and clearing data stored in the memory, said second step comprising clearing the data stored in the memory if the call of the single digit has already been generated when the call of the multiple of 10 is generated.

2. In an elevator provided with a plurality of register indicating lamps, equivalent to the number of floors that the elevator provides service, and a plurality of output buffers which are respectively connected with the register indicating lamps, an elevator car call register method comprising:

a first step for making a CPU recognize a call when a passenger presses a call button of a multiple of 10 and a call button of a single digit;

a second step of storing each data, corresponding to a call of the single digit and a call of the multiple of 10, in a memory in a predetermined format when the call is judged to be appropriate or clearing data stored in the memory when the call is not appropriate; and a third step for determining that a call, generated when a set button is pressed, is a correct one, combining the data stored in the memory, and outputting the combined data to the car controller, thereby enabling a car controller to initiate movement of the elevator car to a desired floor and clearing data stored in the memory, said second step comprising a first stage for determining whether the call of the single digit is generated when the call of the multiple of 10 is not generated, a second stage for clearing the data stored in the memory when two or more call buttons of the multiple of 10 are pressed, a third stage for clearing the data stored in the memory if the call of the single digit has already been generated when the call of the multiple of 10 is generated, and a fourth stage for clearing the data stored in the memory when two or more call buttons of the single digit are pressed, or storing data which correspond to the call of the single digit in the memory.

3. The method of claim 1, wherein the second step further comprises clearing the data stored in the memory when a reset button is pressed, during the performance of the second step.

4. The method of claim 1, wherein the third step further comprises clearing the data stored in the memory when a set button is not pressed within a predetermined time, after the second step is performed.

* * * * *